US006507284B1

(12) United States Patent
Rothney

(10) Patent No.: US 6,507,284 B1
(45) Date of Patent: Jan. 14, 2003

(54) ENCLOSURE SIGN DEVICE

(75) Inventor: Marc Thomas Rothney, Boulder, CO (US)

(73) Assignee: Roche Colorado Corporation, Boulder, CO (US)

( * ) Notice: Subject to any disclaimer, the term of this patent is extended or adjusted under 35 U.S.C. 154(b) by 0 days.

(21) Appl. No.: 09/549,126

(22) Filed: Apr. 13, 2000

Related U.S. Application Data

(60) Provisional application No. 60/128,945, filed on Apr. 13, 1999.

(51) Int. Cl.[7] ..... G08B 23/00

(52) U.S. Cl. ..... 340/693.5; 340/542; 340/545; 40/331

(58) Field of Search ..... 340/693.5, 545, 340/542, 574; 40/331, 488

(56) References Cited

U.S. PATENT DOCUMENTS 4,212,003 A * 7/1980 Mishoe et al. ..... 340/574
4,852,284 A * 8/1989 Faggiano ..... 40/488
4,897,945 A * 2/1990 Webb ..... 40/331
4,951,045 A * 8/1990 Knapp et al. ..... 340/944
5,191,314 A * 3/1993 Ackerman et al. ..... 340/542
5,392,025 A * 2/1995 Figh et al. ..... 340/545
5,448,842 A * 9/1995 Sonstroem ..... 40/331
6,067,011 A * 5/2000 Leslie ..... 340/468

* cited by examiner

*Primary Examiner*—Benjamin C. Lee
*Assistant Examiner*—Phung T Nguyen
(74) *Attorney, Agent, or Firm*—Townsend and Townsend and Crew LLP

(57) ABSTRACT

The present invention provides an enclosure sign apparatus for unavoidable viewing of a sign before manipulation of an entryway opening device. The enclosure sign apparatus includes at least one side surface extending out as least as far as the entryway opening device, a back surface interconnected to the side surface, wherein the back surface comprises an opening to accommodate the entryway opening device therethrough, and a front surface having a sign. The front surface is capable of preventing access to the entryway opening device and is interconnected to the side surface. When in use, access is obtained to an entryway opening device by physically removing the enclosure sign apparatus so that there is unavoidable viewing of a sign before manipulation of the entryway opening device.

20 Claims, 5 Drawing Sheets

ENCLOSURE SIGN DEVICE

CROSS-REFERENCE TO RELATED APPLICATIONS

This application claims the benefit of U.S. Provisional Application Ser. No. 60/128,945, filed Apr. 13, 1999, which is incorporated herein by reference in its entirety.

FIELD OF THE INVENTION

The present invention relates to warning sign apparatus and more specifically, to entryway opening device enclosure sign apparatus for unavoidable viewing of a sign before manipulation of an entryway opening device.

BACKGROUND OF THE INVENTION

A variety of devices are utilized to advise or alert others of information. In industrial settings, alerting others of a possible danger or preventing others from entering a particular entryway is important to prevent an accidental exposure of a person(s) to a potentially hazardous condition. Typically, a lighted or unlighted sign is the most commonly used device for a warning. However, simply placing a warning sign on or near the entryway does not always prevent a person from encountering the hazardous condition which may exist beyond the entryway. For example, when one's mind is preoccupied with some other task, one may not see the warning sign or fully realize the potential consequences of entering the entryway. Even if one sees the warning sign, it may not properly register in one's mind of the potential dangers that may lie beyond the entryway. This may be especially true if a person is accustomed to seeing a warning sign frequently in a particular entryway.

One way to prevent accidental entry through an entryway (i.e., door), for example, due to a mental lapse, is to compel a person to perform a physical task prior to entering the entryway.

One possible method for preventing an accidental entry through an entryway is to lock the entryway opening device. However, this may pose a dangerous situation when there is an emergency situation which may require exiting through the entryway quickly from one or both sides of the entryway.

Therefore, there is a need for an apparatus which requires (i.e., forces or compels) a person to perform a physical task prior to entering the entryway when a possible hazardous condition exists on the other side of the entryway. There is also a need for an apparatus which can be easily removed when a quick exit through the entryway is desired.

SUMMARY OF THE INVENTION

The present invention provides an enclosure sign apparatus for unavoidable viewing of a sign before manipulation of an entryway opening device, e.g., a door knob or a latch. The apparatus for enclosing an entryway opening device includes at least one side surface extending out at least as far as the entryway opening device and a back surface interconnected to the side surface to accommodate the entryway opening device through an aperture present in the back surface. The apparatus also contains a front surface having or amenable for affixing a sign, e.g., a warning notice, and interconnected to the side surface. The front surface prevents access to the entryway opening device when in use. The apparatus also contains a coupling mechanism for coupling the apparatus to the door and/or the doorframe. Optionally, the enclosure sign apparatus can include a visual and/or audible alert device. Preferably, the back surface includes a magnetic material to couple (i.e., attach) the enclosure apparatus to the door.

Alternatively, the front surface of the apparatus can contain a sign display. The sign display can include a pane frame which surrounds, and is coupled on at least two sides, preferably three sides, to the pane. The pane includes a notch so that an appropriately sized sign may be slidingly inserted between the pane and the front surface. A notch allows a grip access to the sign for interchangeability.

Access is obtained to an entryway opening device by physically removing the enclosure sign device which encloses, e.g., covers, the entryway opening device. The side surface-of the device can include an aperture and/or a handle to facilitate the removal of the enclosure sign device.

BRIEF DESCRIPTION OF THE INVENTION

DETAILED DESCRIPTION OF THE INVENTION

Figure 1A:
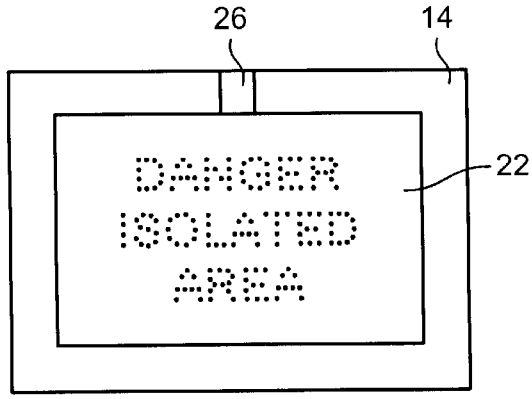
FIG. 1A is a front-view of one embodiment of an enclosure sign apparatus of the present invention having a rectangular shape.
Figure 1B:
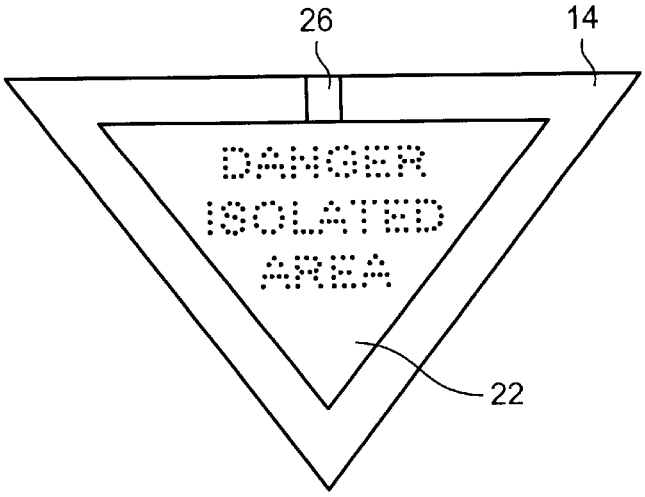
FIG. 1B is a front-view of one embodiment of an enclosure sign apparatus of the present invention having a triangular shape.
Figure 2:
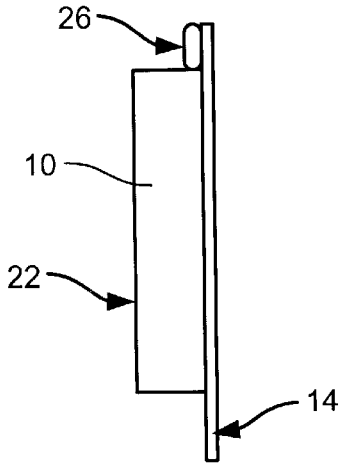
FIG. 2 is a side-view of one embodiment of an enclosure sign apparatus of the present invention.
Figure 3:
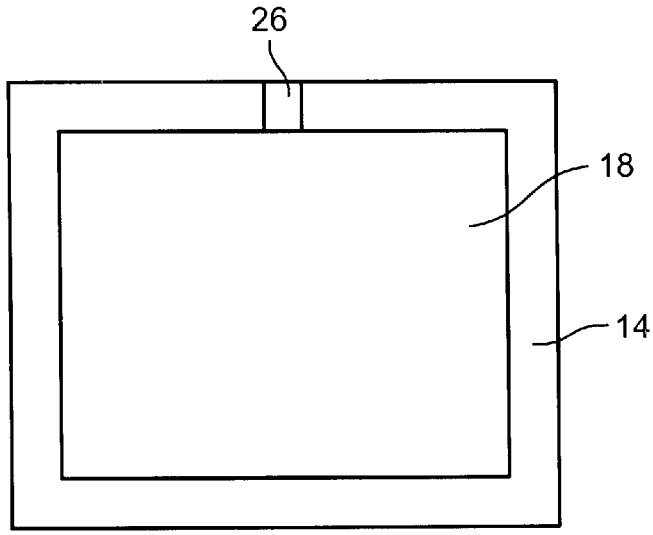
FIG. 3 is a back-view of one embodiment of an enclosure sign apparatus of the present invention.
Figure 4:
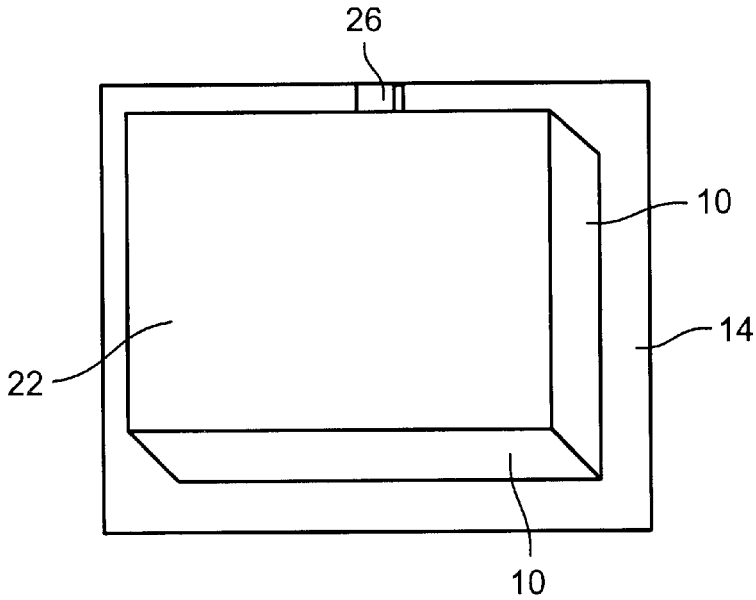
FIG. 4 is a perspective-view of one embodiment of an enclosure sign apparatus of the present invention.

The present invention will be described with regards to the accompanying drawings which assist in illustrating various features of the invention. In this regard, the present invention generally relates to an enclosure sign apparatus. That is, the invention relates to an apparatus which requires a physical manipulation of the apparatus to gain access to an entryway opening device, thus providing unavoidable viewing of the sign.

The enclosure sign apparatus of the present invention includes at least one side surface 10, depicted as surrounding four sides, which extends out at least as far as the entryway opening device, e.g., a doorknob, latch or any entryway opening device (See FIGS. 1–8). The number of side surfaces surrounding the apparatus generally depends on a particular geometric pattern of the apparatus. However, it should be appreciated that the number of side surfaces can be less or more than the sides present in the geometric pattern of the apparatus. The apparatus includes a back surface 14 which has a cavity 18 to accommodate the entryway opening device therethrough. The term "back surface" refers to the portion of the enclosure sign device which, when the device is placed on a flat surface, contacts the flat surface. Thus, the back surface 14 can be a solid continuous planar surface or if the enclosure sign device is hollow, the back surface 14 can be defined as the edges or the lip of the side surface and/or the top surface (if the top surface is curved and no distinct side surface exists) which can contact a flat surface. It should be recognized, however, that the enclosure sign apparatus can include feet on the back surface 14, and thus, the back surface 14 may not directly contact a flat surface when placed on a flat surface. The cavity (or an aperture) 18 in the back surface 14 should be large enough to enclose or cover the entryway opening device completely when the apparatus is in use.

The enclosure sign apparatus of the present invention also includes a front surface 12 which is interconnected to the side surface 10. The front surface 22 also includes a sign or a sign display mechanism. The sign can be temporarily of permanently attached, painted or inscribed on to the front surface 22. Alternatively, the front surface 22 can include a pane frame 38 (see FIG. 7) which surrounds, and is coupled on at least two sides, preferably three sides, to a pane. The pane can include a notch (not shown) so that an appropriately sized sign may be slidingly inserted between the pane and the front surface. A notch allows a grip access to the sign for interchangeability. In this manner, a variety of signs can be interchangeably inserted into the pane allowing a variety of information to be conveyed by the enclosure sign apparatus of the present invention.

The enclosure sign apparatus of the present invention can also include a visual and/or audible alert device. Such alert devices can be an integral part of the enclosure sign apparatus, or they can be a separate device which can be attached to the enclosure sign apparatus. For example, a clip-on visual alert device which emits light (either constantly or intermittently) can be clipped on to the notch 26 of the enclosure sign apparatus to further alert a person to a potentially hazardous condition which may exist beyond the entryway. Alternatively an audible alert device which emits an audible sound (either constantly or intermittently, preferably intermittently) in conjunction with or in place of a visual alert device may be used.

The enclosure sign apparatus of the present invention also includes a mechanism for coupling the apparatus to the entryway (i.e., door). When in use, the enclosure sign device attaches to the entryway, covers and prevents access to the entryway opening device. In this manner, in order to gain access to the entryway opening device, one must physically remove the enclosure sign apparatus away from the entryway opening device. This ensures that the sign is unavoidably viewed prior to gaining access to the entryway opening device when the apparatus is in use. Any method of coupling the enclosure sign apparatus to the entryway can be used. For example, the enclosure sign apparatus and the entryway can be fitted with a corresponding pin and slot mechanism; snap; hook and loop mechanism (e.g., Velcro®); hook and hanger-type mechanism; metal and magnet; and/or non-permanent adhesives.

For an entryway having a doorknob or a similar opening device a variety of other methods or devices are also available for coupling the apparatus to the entryway. For example, the apparatus can have a clip-on half basket, including a multi-prong or a single-piece coupling unit, on the back for attaching the device to a door knob or a similar device (e.g., FIGS. 8A–8C). When a clip-on half basket is used, the clip-on half basket can be confined within the side surfaces of the apparatus (not shown). Alternatively, the apparatus can have one or more, preferably at least 2, more preferably at least 3 legs and most preferably at least 4 legs (or side surfaces) to aid in stabilizing the front surface of the apparatus parallel to the door. The apparatus can have a multi-slit opening on the back for inserting and coupling the doorknob or a similar device (e.g., FIG. 8D) . The apparatus can have an opening on the back for simply inserting the doorknob or a similar device (e.g., FIG. 8E). Or the apparatus can have a "figure-eight" or a "keyhole" like opening on the back, see FIG. 8F, where the doorknob or a similar device is inserted through the larger opening and the apparatus is then lowered such that the smaller opening rests on the doorknob stem or a similar device. Generally, when the apparatus is attached to a doorknob or a similar device rather than the entryway (e.g., doorframe) the attaching mechanism is preferably vertically offset from the center as shown in FIGS. 8A–8F. This allows the apparatus to be attached to the doorknob or similar device without being rotated due to the gravitational force.

When not in use, the enclosure sign apparatus may be placed or stored near the entryway opening device, for example, on the door but away from the entryway opening device (e.g., a doorknob or a latch). In this manner the enclosure sign apparatus is readily available for use when needed. Moreover, when not in use, the enclosure sign apparatus can be placed upside-down (or it can be turned sideways) to further convey the message that one is not prohibited from entering the entryway.

In one particular embodiment of the present invention the back surface 14 of the enclosure sign apparatus includes a magnetic material which allows coupling of the enclosure sign apparatus to a metallic door. The strength of the net magnetic force should be strong enough to allow the enclosure sign apparatus to remain attached to the door even when the door is opened from the other side. However, the net magnetic force should be weak enough to allow for relatively easy removal of the enclosure sign apparatus from the door. The appropriate range of magnetic strength depends on a variety of factors including the composition (and thus the magnetic susceptibility) of the entryway and the thickness of paint or other coatings on the entryway.

Figure 5:
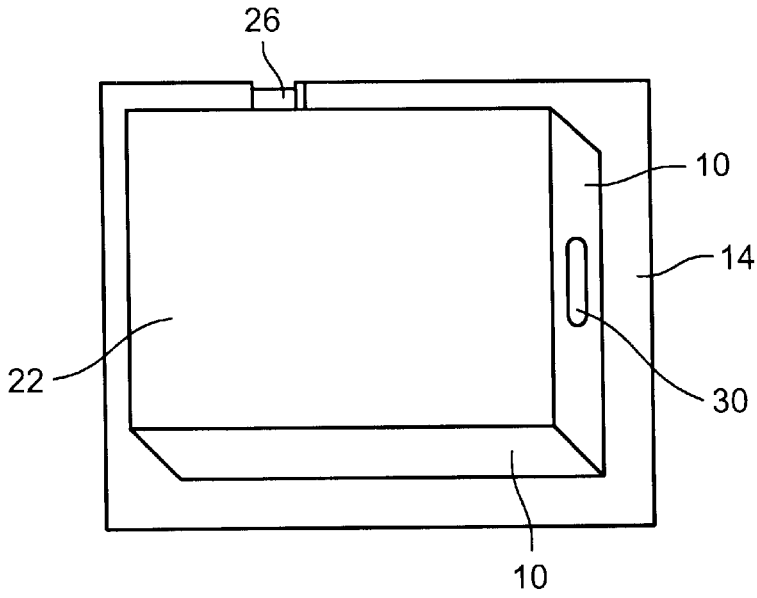
FIG. 5 is a perspective-view of one embodiment of an enclosure sign apparatus of the present invention having an aperture in the side surface.
Figure 6:
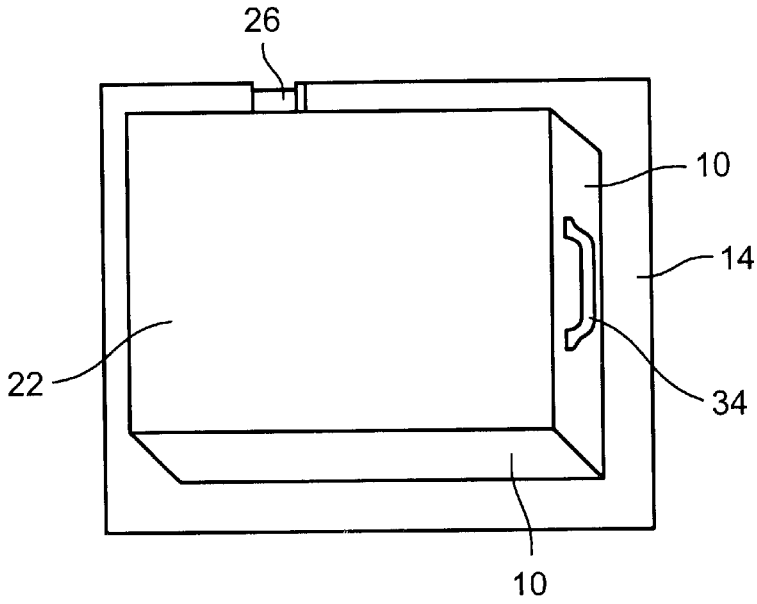
FIG. 6 is a perspective-view of one embodiment of an enclosure sign apparatus of the present invention having a handle in the side surface.
Figure 7:
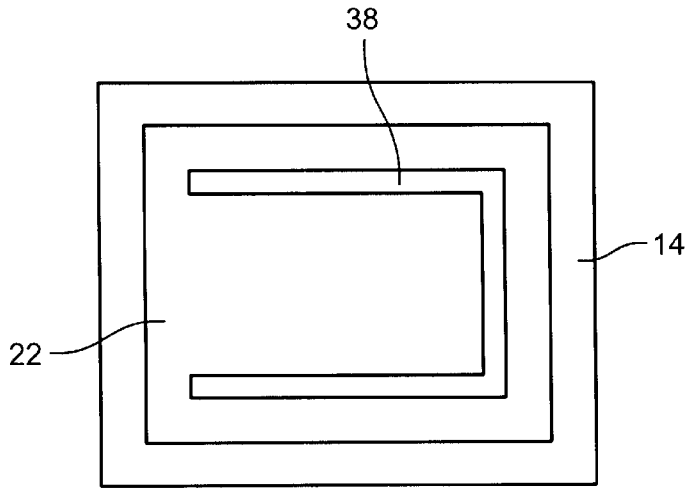
FIG. 7 is a perspective-view of one embodiment of an enclosure sign apparatus of the present invention having a pane for holding a sign.
Figure 8A:
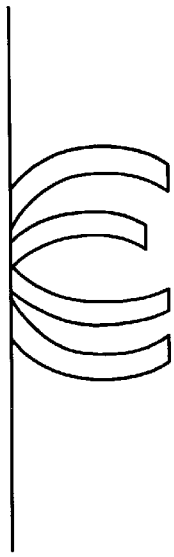
FIGS. 8A–8F show a variety of methods and/or mechanisms for attaching the enclosure sign apparatus of the present invention to a door knob or a similar device.
Figure 8B:
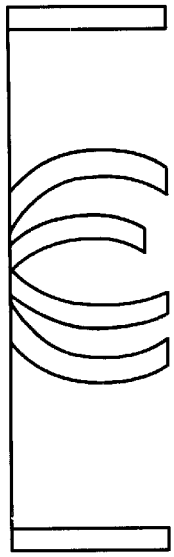
Figure 8C:
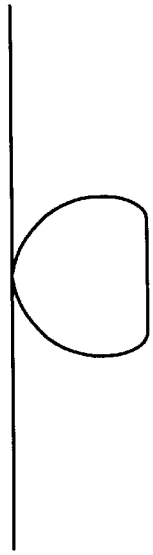
Figure 8D:
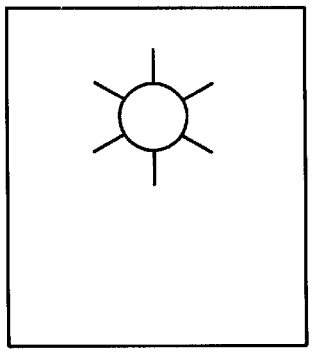
Figure 8E:
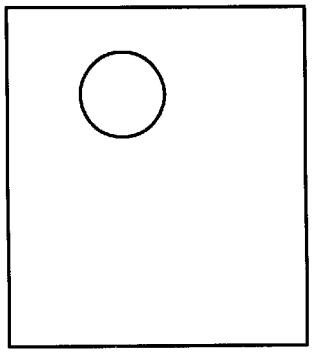
Figure 8F:
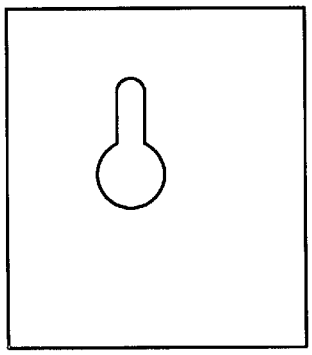

The enclosure sign apparatus of the present invention can also include one or more of an opening 30 (i.e., an aperture), for example, see FIG. 5, and/or handle 34 (see FIG. 6) on the side surface 10 to allow easy manipulation of the enclosure sign apparatus. Alternatively, such opening or handle can be located on the front surface 22 or the back surface 14.

The material for constructing the enclosure sign apparatus can be plastic, metal, wood, cardboard, combinations thereof, or other similar materials. In general, any material which serves the purpose of the device would be acceptable.

The present embodiment is shown in FIGS. 1–8 as having a rectangular box-like shape; however, the invention is not limited to such shape. Generally, the front surface can be a variety of shapes with corresponding side surface which connects the front surface to the back surface. For example, the front surface of the enclosure sign device may be a triangle, circle, oval, square, rectangle, pentagon, hexagon, octagon or other similar curved, curvilinear or polygon shape. In this manner, the enclosure sign apparatus of the present invention can be a wide variety of shapes such as a cylindrical tube-like enclosure with a flat circular front surface, a polygon enclosure, a prism enclosure or an octagonal enclosure reminiscent of a "stop sign." The side surface can be slightly angled or perpendicular to the front surface.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

What is claimed is:

1. An apparatus for unavoidable viewing of a sign before manipulation of an entryway opening device comprising:

(a) at least one side surface extending out at least as far as the entryway opening device;

(b) a back surface interconnected to said side surface, wherein said back surface comprises an aperture to accommodate the entryway opening device therethrough;

(c) a front surface comprising a sign, wherein said front surface is non releasably interconnected to said side surface and is capable of preventing access to the entryway opening device; and (d) a mechanism interconnected to said apparatus for non-fixedly coupling said apparatus about the entryway opening device.

2. The apparatus of claim 1, wherein said mechanism for coupling comprises a magnet.

3. The apparatus of claim 1, wherein said back surface further comprises a magnetic material.

4. The apparatus of claim 1, wherein said side surface comprises an aperture.

5. The apparatus of claim 1, wherein said side surface comprises a handle.

6. The apparatus of claim 1, further comprising a visual alert device interconnected to said apparatus.

7. The apparatus of claim 6, wherein said visual alert device comprises a light emitting device.

8. The apparatus of claim 1, further comprising an audio alert device interconnected to said apparatus.

9. The apparatus of claim 8, wherein said audio alert device comprises an audible sound emitting device.

10. An apparatus for unavoidable viewing of a sign before manipulation of an entryway opening device comprising:

(a) at least one side surface extending out at least as far as the entryway opening device;

(b) a back surface interconnected to said side surface, wherein said back surface comprises:

(i) an aperture to accommodate the entryway opening device therethrough, and (ii) a magnetic material for non-fixedly coupling said apparatus about the entryway opening device; and (c) a front surface comprising a sign and non-releasably interconnected to said side surface, wherein said front surface prevents access to the entryway opening device when the entryway opening device is accommodated through said aperture.

11. The apparatus of claim 10, wherein said side surface comprises an aperture.

12. The apparatus of claim 10, wherein said side surface comprises a handle.

13. The apparatus of claim 10, further comprising a visual alert device, wherein said visual alert device is a light emitting device.

14. A method for ensuring unavoidable viewing of a sign prior to gaining access to an entryway opening device comprising:

enclosing the entryway opening device with an enclosure sign apparatus, wherein said apparatus comprises:

(a) at least one side surface extending out at least as far as the entryway opening device;

(b) a back surface interconnected to said side surface, wherein said back surface comprises an aperture to accommodate the entryway opening device therethrough;

(c) a front surface comprising a sign, wherein said front surface is non releasably interconnected to said side surface and prevents access to the entryway opening device; and (d) a mechanism interconnected to said apparatus for non-fixedly coupling said apparatus about the entryway opening device.

15. The method of claim 14, wherein said back surface further comprises a magnetic material.

16. The method of claim 14, wherein said side surface comprises an aperture.

17. The method of claim 14, wherein said side surface comprises a handle.

18. The method of claim 14, wherein said apparatus further comprises a visual alert device interconnected to said apparatus.

19. The method of claim 18, wherein said visual alert device comprises a light emitting device.

20. The method of claim 14, wherein said apparatus further comprises an audio alert device interconnected to said apparatus, and wherein said audio alert device emits an audible sound.

* * * * *